US008955194B2

(12) United States Patent
Teta et al.

(10) Patent No.: US 8,955,194 B2
(45) Date of Patent: Feb. 17, 2015

(54) FIRE DOOR HINGE WITH FUSIBLE PIN

(71) Applicant: Jeffrey M. Teta, Hampstead, NC (US)

(72) Inventors: Jeffrey M. Teta, Hampstead, NC (US); Hugh James Hawthorne, Hampstead, NC (US); Robin David Stokes, Wilmington, NC (US); Andrew Evan Hawkins, Wilmington, NC (US)

(73) Assignee: Jeffrey M. Teta, Hampstead, NC (US)

( * ) Notice: Subject to any disclaimer, the term of this patent is extended or adjusted under 35 U.S.C. 154(b) by 0 days.

(21) Appl. No.: 13/786,951

(22) Filed: Mar. 6, 2013

(65) Prior Publication Data

US 2013/0247329 A1 Sep. 26, 2013

Related U.S. Application Data

(63) Continuation-in-part of application No. 12/790,592, filed on May 28, 2010, now abandoned, which is a continuation-in-part of application No. 12/356,448, filed on Jan. 20, 2009, now abandoned.

(51) Int. Cl.

| | |
|---|---|
| ***E05F 1/12*** | (2006.01) |
| ***E05F 1/00*** | (2006.01) |
| ***A62C 2/24*** | (2006.01) |

(52) U.S. Cl.

CPC ..... *E05F 1/1207* (2013.01); *E05F 1/006* (2013.01); *A62C 2/242* (2013.01); *E05F 1/1215* (2013.01); *E05Y 2900/134* (2013.01)

USPC ..... 16/48.5; 16/222

(58) Field of Classification Search

CPC ..... E05Y 2900/134; E05Y 2800/252; E05Y 2800/342; E05F 1/1207; E05F 1/1215; E05F 1/006; A62C 2/12; A62C 2/242

USPC ..... 16/48.5, 222

See application file for complete search history.

(56) References Cited

U.S. PATENT DOCUMENTS

| | | | | |
|---|---|---|---|---|
| 2,043,198 A | | 6/1936 | Heverly | |
| 2,520,536 A | * | 8/1950 | Feeley | 16/222 |

(Continued)

FOREIGN PATENT DOCUMENTS

| | | |
|---|---|---|
| GB | 1 549 636 | 8/1979 |
| KR | 20030079510 A | 10/2003 |

(Continued)

OTHER PUBLICATIONS

International Search Report, International Preliminary Report on Patentability and Written Opinion of the International Searching Authority of PCT/US2014/019287 in English, mailed Jun. 3, 2014.

(Continued)

*Primary Examiner* — Jeffrey O Brien

(74) *Attorney, Agent, or Firm* — Collard & Roe, P.C.

(57) ABSTRACT

A closures mechanism for a door actuated during a fire, which causes the door to automatically close. The present invention provides a hinge with opposing hinge plates comprising a door leaf and a frame leaf each pivotal around a hinge pin and spring. A hinge spring nub is anchored within a channel having a fusible block that prevents the spring nub and tension from traveling the channel. At a predetermined temperature the fusible block ruptures causing the spring nub and spring tension to move into engagement with the door attached to the hinge door leaf thereby causing the door to close by means of the tensioned spring's kinetic energy.

10 Claims, 23 Drawing Sheets

(56) References Cited

U.S. PATENT DOCUMENTS

| | | | | |
|---|---|---|---|---|
| 2,797,432 | A | | 7/1957 | Gakle |
| 2,954,106 | A | | 9/1960 | Schlage |
| 3,325,941 | A | | 6/1967 | Prucha |
| 3,403,954 | A | | 10/1968 | Williams |
| RE27,066 | E | | 2/1971 | Williams |
| 3,705,739 | A | | 12/1972 | Adler |
| 3,725,972 | A | | 4/1973 | McCabe |
| 3,729,771 | A | | 5/1973 | Crane et al. |
| 3,744,832 | A | | 7/1973 | Casey et al. |
| 3,777,422 | A | | 12/1973 | Janssen |
| 3,779,004 | A | | 12/1973 | Gloeckler |
| 3,937,506 | A | | 2/1976 | Dean |
| 3,983,599 | A | | 10/1976 | Takashiro |
| 4,012,066 | A | | 3/1977 | Salvatore |
| 4,074,388 | A | | 2/1978 | McCabe |
| 4,102,013 | A | | 7/1978 | Newlon |
| 4,121,319 | A | | 10/1978 | Welch |
| 4,161,804 | A | | 7/1979 | D'Hooge et al. |
| 4,183,565 | A | | 1/1980 | Allemann |
| 4,635,729 | A | | 1/1987 | Harmathy |
| 4,714,285 | A | | 12/1987 | Langham |
| 4,726,613 | A | | 2/1988 | Foshee |
| 4,905,344 | A | | 3/1990 | McCabe |
| 5,058,236 | A | * | 10/1991 | Henson ..... 16/222 |
| 5,121,950 | A | | 6/1992 | Davidian |
| 5,864,920 | A | | 2/1999 | Lasson et al. |
| 2003/0001465 | A1 | | 1/2003 | Carter et al. |
| 2004/0045219 | A1 | | 3/2004 | Tlemcani et al. |
| 2011/0271484 | A1 | | 11/2011 | Irwin |
| 2011/0271485 | A1 | * | 11/2011 | Irwin ..... 16/275 |

FOREIGN PATENT DOCUMENTS

| | | | |
|---|---|---|---|
| KR | 20040026739 | A | 4/2004 |
| KR | 100740809 | A | 7/2007 |

OTHER PUBLICATIONS

Office Action from grandparent application U.S. Appl. No. 12/356,448 Non-Final Rejection Dated Apr. 19, 2011, 14 pages.

Office Action from parent application U.S. Continuation-in-Part U.S. Appl. No. 12/790,592 Non-Final Rejection Dated Oct. 25, 2012, 14 pages.

* cited by examiner 10
16
18
10
6
6
14
14
12

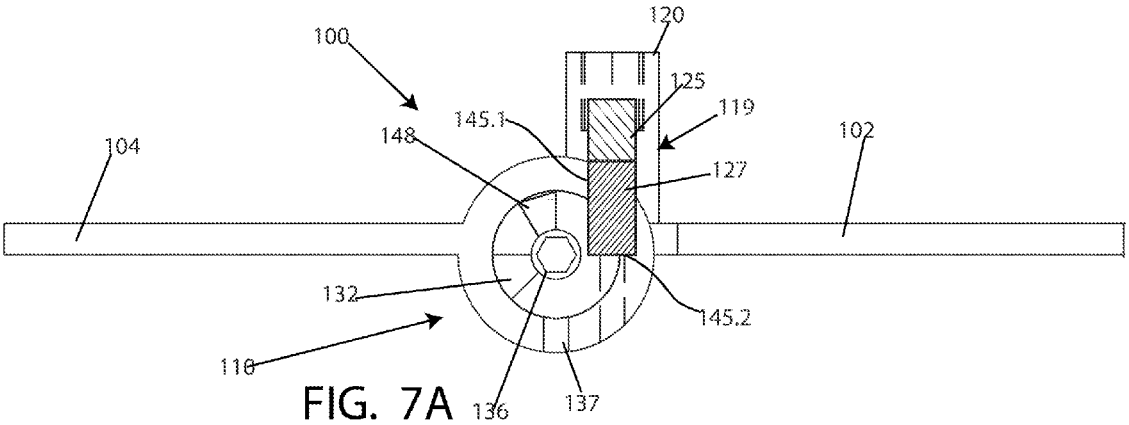
FIG. 7A
FIG. 7B
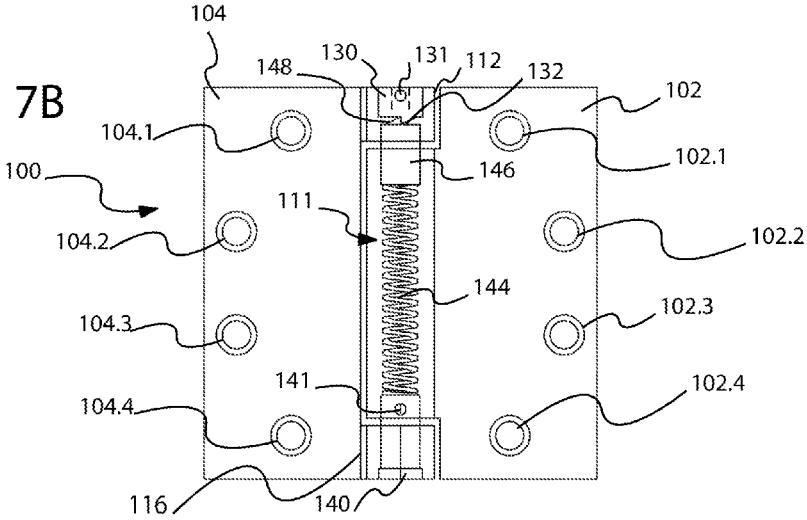

FIG. 8A
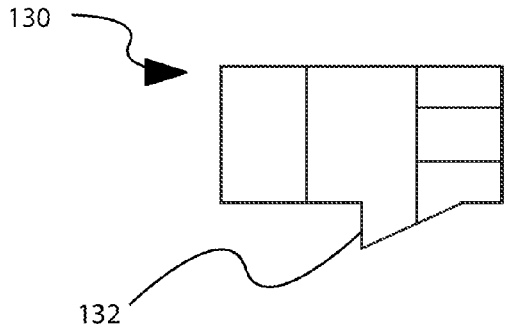
FIG. 8B
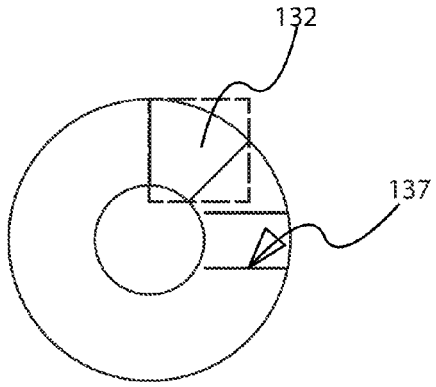
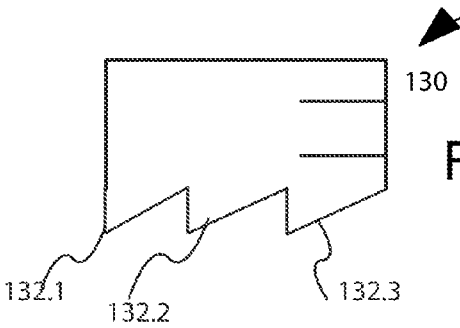
FIG. 8C
FIG. 8D
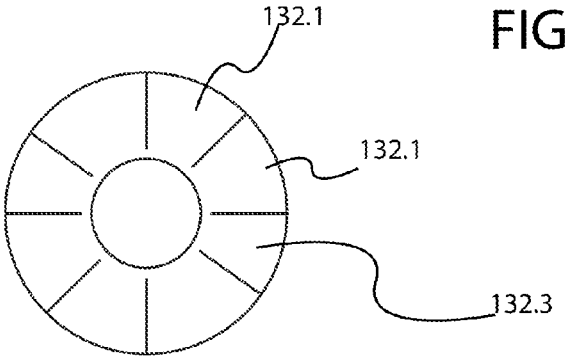

FIG. 10A
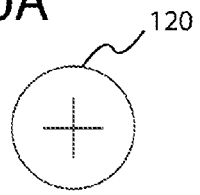
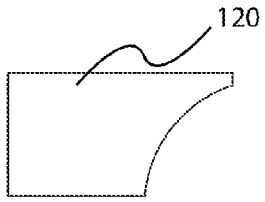
FIG. 10B
FIG. 10C
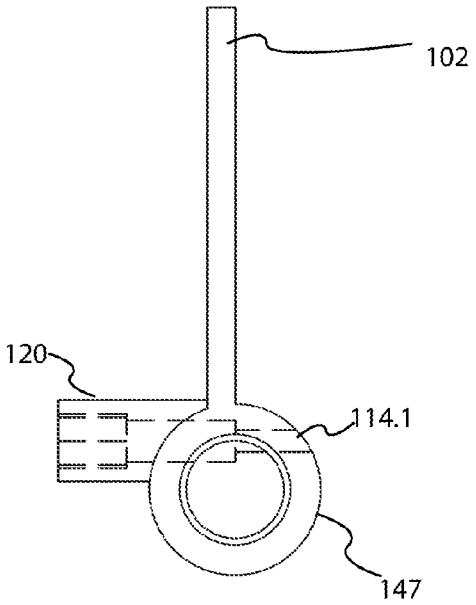

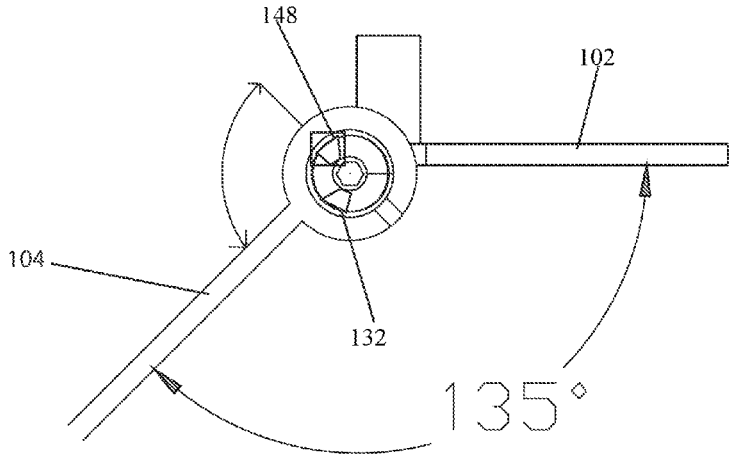
FIG. 11D
FIG. 11E
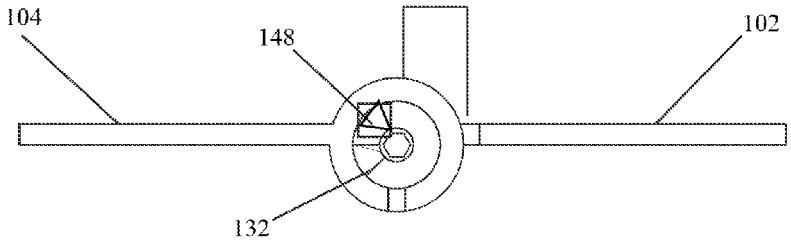
FIG. 11F
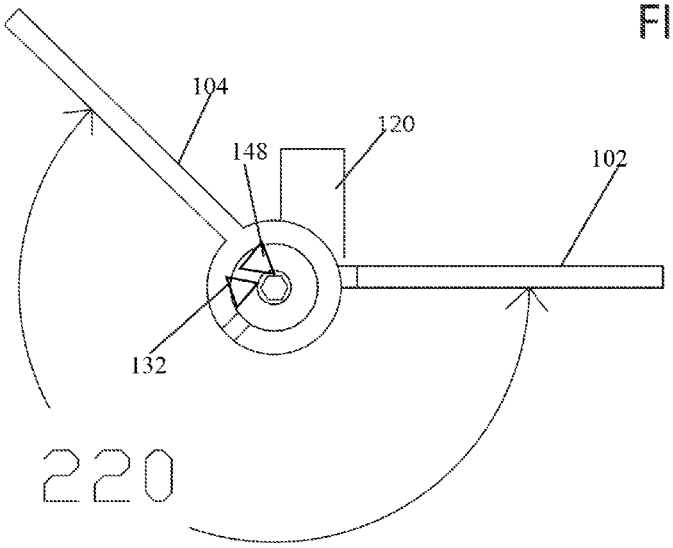

FIRE DOOR HINGE WITH FUSIBLE PIN

This application is a continuation in part of U.S. patent application Ser. No. 12/790,592 filed on May 28, 2010, which is a continuation-in-part of U.S. patent application Ser. No. 12/356,448, filed 20 Jan. 2009. The disclosures of both of these applications are hereby incorporated herein by reference.

BACKGROUND OF THE INVENTION

1. Field of the Invention

The present invention relates generally to hinges and, more specifically, to a closures mechanism for a door actuated during a fire, which causes the door to automatically close. The present invention provides a hinge with opposing hinge plates comprising door leaf and frame leaf pivotal about their respective aligned knuckles that form housing for a rotationally tensioned spring having a knuckle staked tensioning pin straddling the spring on one end and a composite pin on the other end. The composite pin consists of a pair of superjacent pin members having engageable nubs with one pin member knuckle staked and the other straddling the spring is knuckle anchored by a locking pin and fusible block. When stacked together, the locking pin is above the surface of the hinge pin locking the hinge pin and spring under tension. Exceeding a predetermined temperature the fusible block melts allowing the locking pin to displace the liquid metal which releases the anchored pin member of the composite pin that under the aforementioned spring pressure causes its nub to engage the other composite pin member nub forcing the hinged leaves to an engaging closed position thereby forming a hinge for a door that under ambient temperature freely stays in a desired open state until the fusible block ruptures when acted upon by a predetermined temperature, such as through fire, forcing the door to its closed position by virtue of the rotationally tensioned spring's kinetic energy.

2. Description of the Prior Art

There are no known door hinges incorporating fusible blocks that will cause an unattended door to close in case of fire. Since a closed door will inhibit the spread of fire through a structure, it is felt that a need exists for a mechanism that will automatically close a door when a fusible block is ruptured.

SUMMARY OF THE INVENTION

One benefit of one embodiment of the present invention is to provide a mechanism for automatically closing an unattended door during a fire. Another object of the present invention is to provide a hinge having a mechanism for automatically closing an unattended door during a fire. Yet another object of the present invention is to provide a hinge having a pair of hinge leafs with each incorporating a respective knuckle. Still yet another object of the present invention is to provide a hinge wherein the knuckles when co-aligned forms housing for a spring.

Another benefit of another embodiment of the present invention is to provide a hinge having a pair of pins fastenable to the spring's distal ends. A further object of the present invention is to provide a hinge wherein the spring is rotationally tensioned within the housing by the pins. A yet further object of the present invention is to provide a hinge wherein the leaf knuckles each incorporates fastening means for staking a pin thereto.

Another benefit of another embodiment of the present invention is to provide a hinge wherein one of the pins is a spring tensioning pin and the other a composite pin.

Another benefit of another embodiment of the present invention is to provide a hinge wherein the composite pin has a knuckle-staked member and a knuckle-pinned member. Yet another object of the present invention is to provide a hinge wherein the composite pin's knuckle-staked member and knuckle-pinned member each have a nub extending therefrom.

Another benefit of another embodiment of the present invention is to provide a hinge wherein the composite pin's knuckle-pinned member has a cavity forming a seat for receiving a portion of the fusible block.

Another benefit of another embodiment of the present invention is to provide a hinge wherein one of the leafs knuckles has a cavity for receiving a portion of the fusible block.

A further object of the present invention is to provide a hinge wherein the tension pin has an aperture on its distal end for receiving a tool to torque the spring prior to knuckle staking the tension pin.

Another benefit of another embodiment of the present invention is that at a predetermined temperature the fusible block ruptures causing the composite pin's knuckle anchored nub to move into engagement with the composite pin's knuckle-staked nub causing the hinge door leaf to close by means of the tensioned spring's kinetic energy. Additional objects of the present invention will appear as the description proceeds.

The present invention overcomes the shortcomings of the prior art by providing a closures mechanism for a door actuated during a fire, which causes the door to automatically close. The present invention provides a hinge with opposing hinge plates comprising a door leaf and a frame leaf each pivotal around a hinge pin and spring. A hinge spring nub is anchored within a channel having a fusible block that prevents the spring nub and tension from traveling the channel. At a predetermined temperature the fusible block ruptures causing the spring nub and spring tension to move into engagement with the door attached to the hinge door leaf thereby causing the door to close by means of the tensioned spring's kinetic energy. The foregoing and other objects and advantages will appear from the description to follow. In the description, reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 7A is a top view of another embodiment of the present invention;

FIG. 7B is a side view of the embodiment shown in FIG. 7A;

FIG. 8A is a side view of a first embodiment of an end catchment;

FIG. 8B is an end view of this embodiment shown in FIG. 8A;

FIG. 8C is a side view of another embodiment of an end catchment;

FIG. 8D is an end view of the catchment of FIG. 8C;

FIG. 10A is an end view of the cylinder for holding the vented set screw;

FIG. 10B is a side view of the cylinder of FIG. 10A;

FIG. 10C is a top view of the jamb leaf and cylinder;

FIGS. 11A-11F show the first progression of the door leaf or door with the locking pin in a locked position;

DETAILED DESCRIPTION OF PREFERRED EMBODIMENTS

Figure 1:
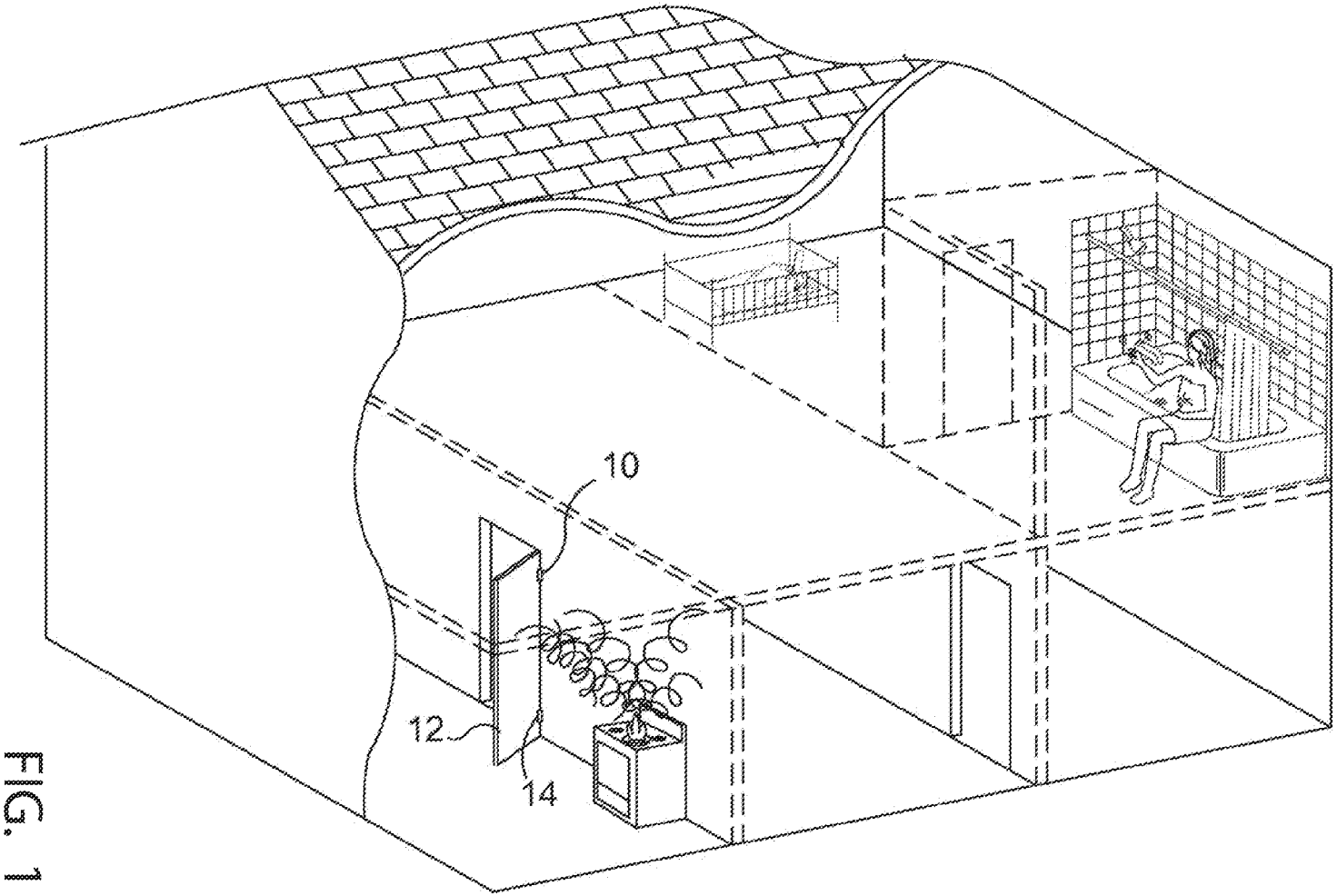
FIG. 1 is an illustrative view of the present invention in use.

The following discussion describes in detail one embodiment of the invention. This discussion should not be construed, however, as limiting the invention to those particular embodiments; practitioners skilled in the art will recognize numerous other embodiments as well. For definition of the complete scope of the invention, the reader is directed to appended claims. Referring to FIG. 1, shown is an illustrative view of the present invention in use. The present invention is a fusible block door hinge 10 that can be used in conjunction with other door hinges 14 for unattended doors 12 that upon a predetermined temperature, the fusible block within the door hinge 10 will rupture, closing the door thereby slowing down the spread of fire within the structure.

Figures 2A, 2B:
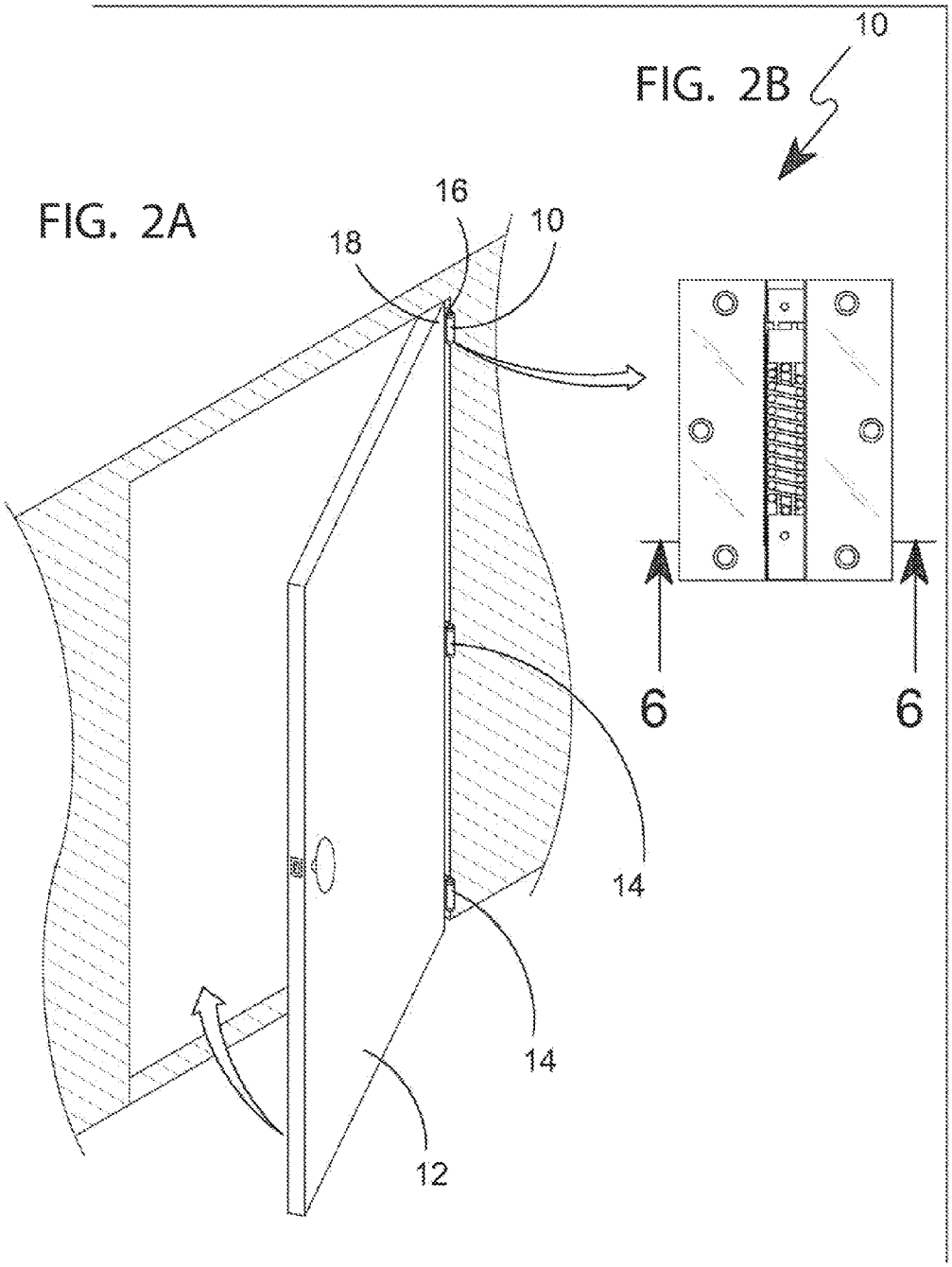
FIG. 2A is an external view of the present invention.
FIG. 2B is a view of the hinge.

Referring to FIG. 2, shown is an illustrative view of the present invention in use. The present invention is a door mechanism for automatically closing a door 12 during a fire consisting of a hinge 10 having a door leaf 18 and jamb leaf 16 incorporating a fusible element that within the hinge knuckle that when broken by a predetermined threshold temperature causes the hinge 10 to close the door. The hinge 10 has the appearance of a typical hinge 14 and is mounted in similar fashion as a regular hinge.

Figure 3:
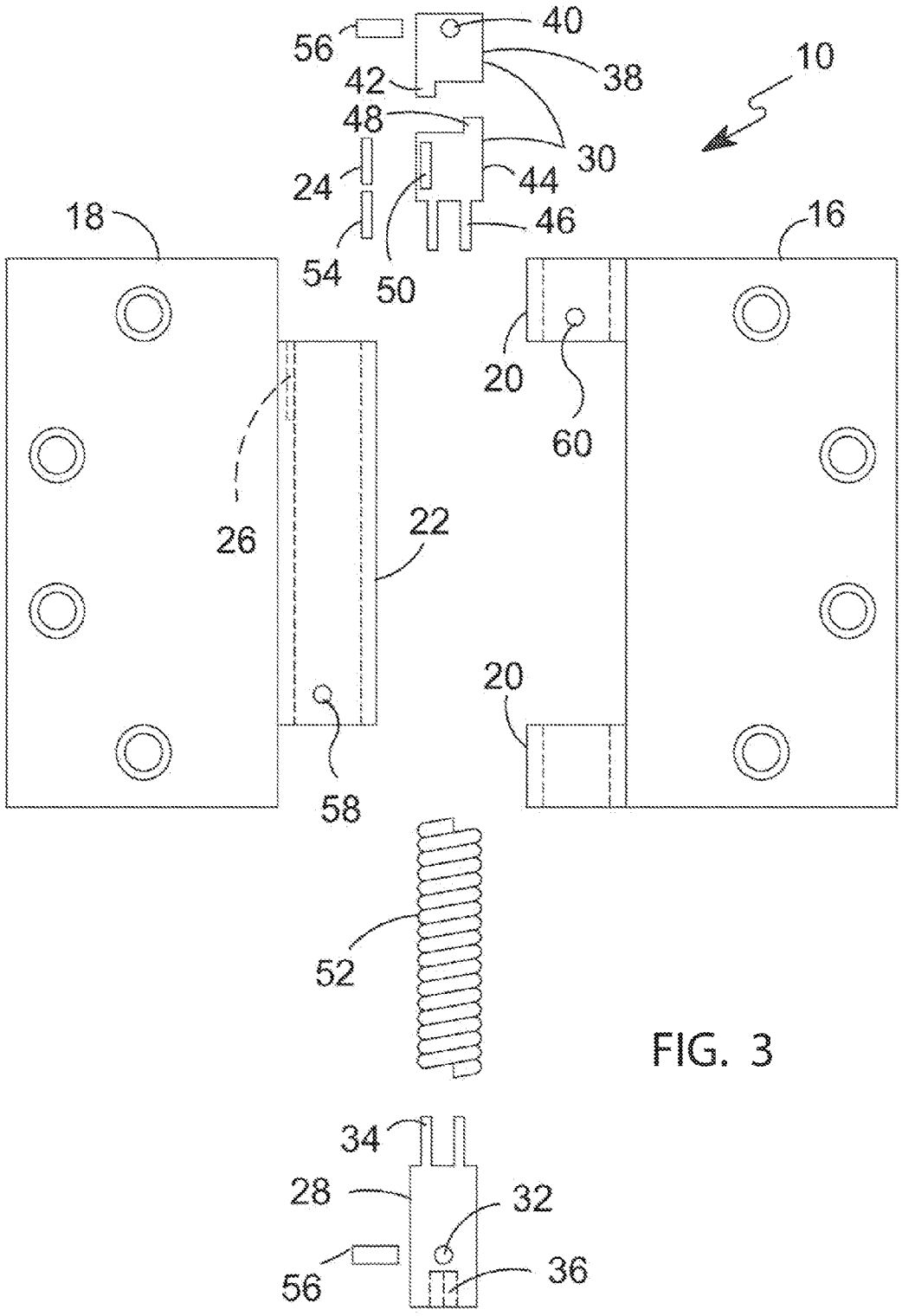
FIG. 3 is an exploded view of the present invention.

FIG. 3 is an exploded view of the present invention. Shown is an exploded view of the present invention, a door hinge having an internal fusible block 54 in communication with a torsion spring 52 that is actuated during a fire, which causes the door to automatically close. A door plate 18 has a knuckle 22 that is linearly positioned between two spaced apart knuckles 20 of the jamb plate 16. Jamb plate 16 has an the upper knuckle 20 having an aperture 60 for receiving roll pin 56 to secure knuckle staked member 38 to knuckle 20 via fastener aperture 40. Torsion spring 52 is secured at one end to the knuckle anchored member 44 and at the other end to the lower tension hinge pin 28. Lower tension hinge pin 28 is secured to lower knuckle 20 via roll pin 56 extending through aperture on knuckle 20'. At the top end spring fastener prongs are secured to the torsion spring while at the opposite end prongs 34 are secured to the spring. For example, a pair of spring fastener prongs 34 projecting upwards therefrom engage the lower end of the spring and a composite hinge pin 30 comprising a knuckle anchored member 44 and a knuckle staked member 38. The knuckle anchored member 44 has a pair of spring fastener prongs 46 projecting downward therefrom to engage the upper end of the spring 52 and a fusible block cavity 50 for receiving the fusible block 54.

The knuckle staked member 38 has a nub 42 projecting downward therefrom to engage the knuckle anchored member 44 and a fastener aperture 40 for receiving a roll pin 56 therethrough. The door plate 18 or door plate knuckle includes a channel 26 which allows knuckle 22 to rotate freely around knuckle anchored member 44 when knuckle anchored member 44 is secured in place via locking pin 24 being in contact with nub 42.

Thus, in at least one embodiment, the tension hinge pin 28 further comprises a fastener aperture 32 to receive a roll pin 56 and a tensioning aperture 36. Thus, when the device is assembled, the spring 52 is set in a coiled position, fixed at a first end of knuckle **20*b* via pin 56 and aperture 58 and aperture 32, and is secured at the opposite end via the locking pin 24 and the fusible block 54 to knuckle staked member 38. The spring remains inactive but coiled inside of knuckles 20*a* 20*b* and 22 in the absence of a fire. During a fire when hot gasses interact, fusible block 54 melts, allowing pin 24 to drop down releasing the lock between knuckle anchored member 44 and knuckle staked member 38 allowing the release of knuckle anchored member 44 causing its rotation in channel 26 until it contacts a solid portion of knuckle 22** thereby driving door leaf closed.

Figure 4:
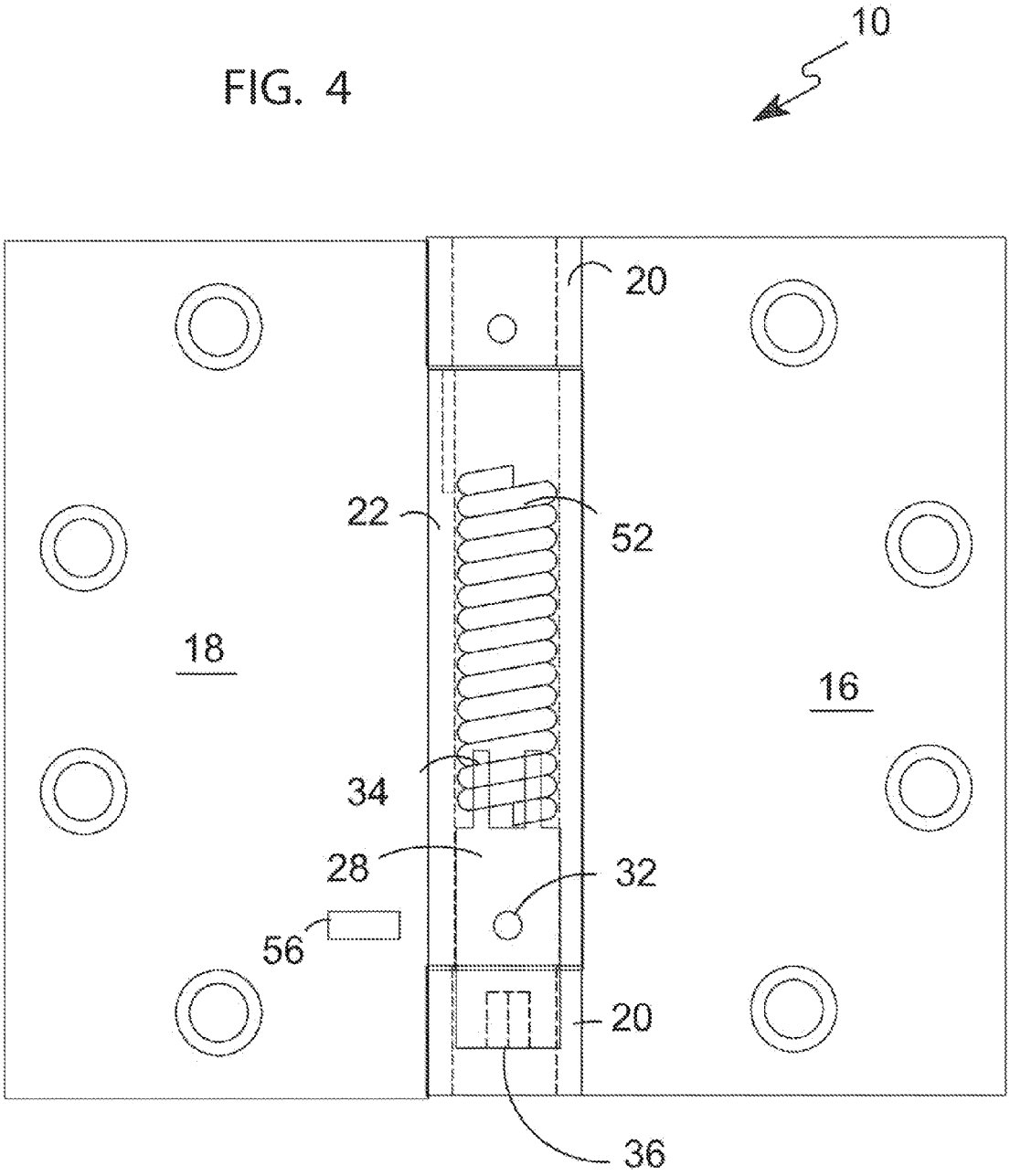
FIG. 4 is a partial exploded view of the present invention.

FIG. 4 is a partial assembled sectional view of the present invention. Shown is a partial assembled sectional view of the present invention with the hinge plates 16,18 aligned and the bottom hinge pin 28 and spring 52 assembled within the knuckles 20,22. Once the hinge is completely assembled a driver (not shown) is inserted in aperture 36 of hinge pin 28 and rotated impinging rotational potential energy onto the torsion spring 52 where then roll pin 56 is inserted into tension hinge pin fastener aperture 32.

Figure 5:
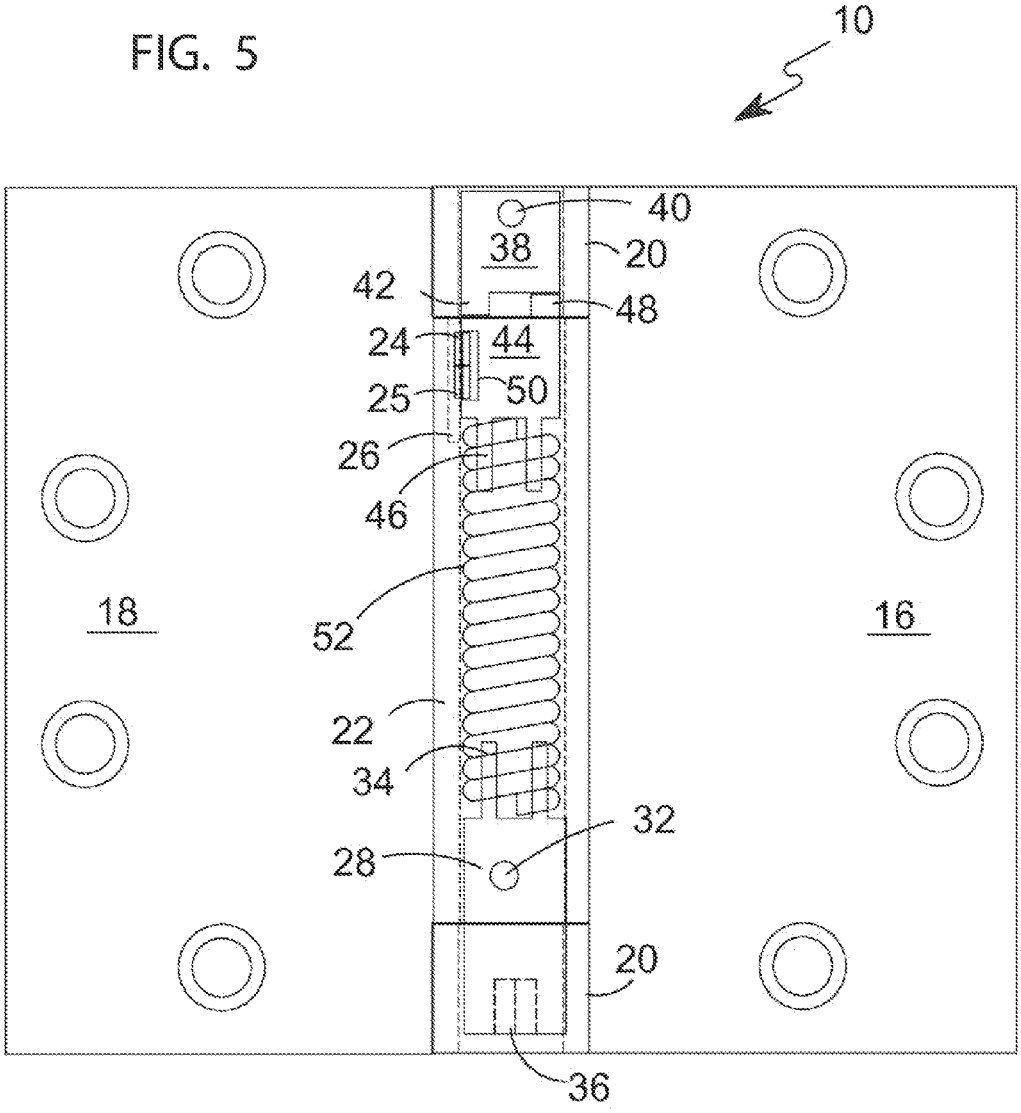
FIG. 5 is a partial exploded sectional view of the present invention.

FIG. 5 is a sectional view of another embodiment. This embodiment provides a hinge with opposing hinge plates comprising door leaf 18 and frame leaf 16 pivotal about their respective aligned knuckles 20, and 22 that form housing for a rotationally tensioned spring 52 having a knuckle staked tensioning pin 28 straddling the spring on one end and a composite pin 30 on the other end. In this design, pin 28 is secured to knuckle 22. The composite pin 30 consists of a pair of superjacent pin members 38, 44 having engageable nubs 42, 48 with one pin member 38 knuckle staked to top knuckle 20 and the other 44 straddling the spring is knuckle anchored by a locking pin 24 and fusible block 54. When stacked together the locking pin 24 is above the surface of the hinge pin 42 locking the hinge pin and spring under tension, locking a door in an open position. Exceeding a predetermined temperature the fusible block 54 melts allowing the locking pin 24 to displace the liquid metal which releases the anchored pin member 44 of the composite pin 30 that under the aforementioned spring pressure causes its nub 48 to engage the other composite pin member nub 42 forcing the door plate 18 to an engaging closed position thereby forming a hinge for a door that under ambient temperature stays in a desired open state until the fusible block ruptures when acted upon by a predetermined temperature, such as through fire, forcing the door to its closed position by virtue of the rotationally tensioned spring's kinetic energy. With this design fusible link 54 in combination with locking pin 24 keeps the door from closing by locking it in an open position by fixing knuckle 22 to knuckle 20. When a fire occurs fusible link 54 falls down thereby releasing the lock between the knuckles allowing the spring tension of spring 52 to drive door leaf 18 with knuckle 22 free from knuckle 20*a* into a closed position. Thus, in the first embodiment shown in FIG. 3 the spring is locked and then released into action in the event of a fire, while in the second embodiment of FIGS. 5 and 6 the hinge is locked and then released into action in the event of a fire.

Figure 6:
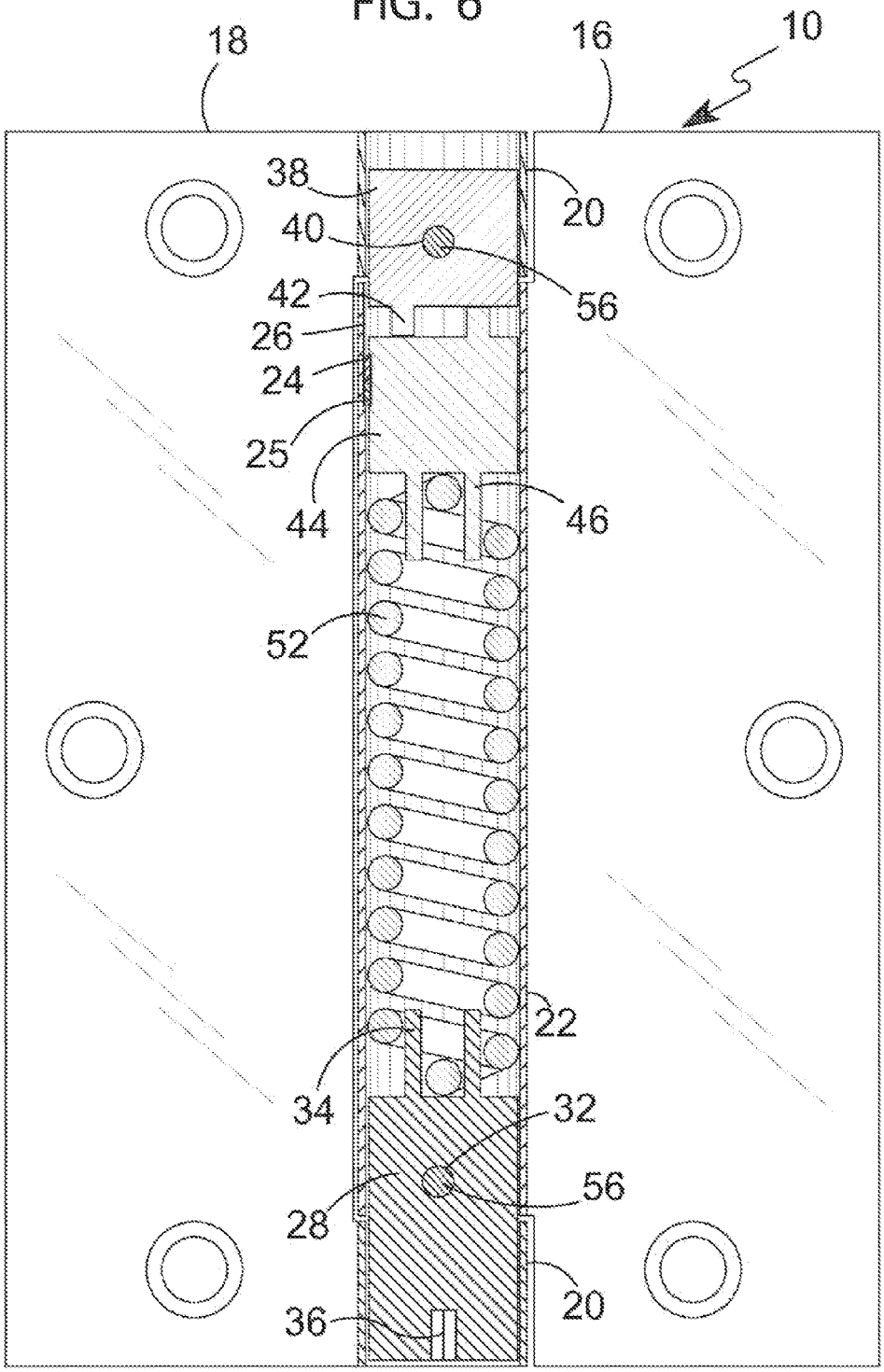
FIG. 6 is an assembled sectional view of the present invention.

FIG. 6 is a cross sectional view of the embodiment of FIG. 5 as indicated showing an assembled sectional view of the present invention. The present invention provides a hinge with opposing hinge plates comprising door leaf 18 and frame leaf 16 pivotal about their respective aligned knuckles 20, 22 that form housing for a rotationally tensioned spring 52 having a knuckle staked tensioning pin 28 straddling the spring on one end and a composite pin 30 on the other end. The composite pin 30 consists of a pair of superjacent pin members 38, 44 having engageable nubs 42, 48 with one pin member 42 knuckle staked and the other 48 straddling the spring is knuckle anchored by a locking pin 24 and fusible block 54. The locking pin 24 is disposed above the fusible block, wherein the fusible block is disposed partially within the fusible block channel. When stacked together the locking pin 24 is configured to descend or move down into the fusible block cavity and is above the surface of the hinge pin 42 locking the hinge pin and spring under tension. Exceeding a predetermined temperature the fusible block 54 melts allowing the locking pin 24 to descend or move down into the fusible block cavity and displace the liquid metal which releases the anchored pin member 44 of the composite pin 30 that under the aforementioned spring pressure causes the door to swing closed, causing its nub 48 to engage the other composite pin member nub 42 forcing the door plate 18 to an engaging closed position. This design thereby forms a hinge for a door that under ambient temperature freely stays in a desired open state until the fusible block ruptures when acted upon by a predetermined temperature, such as through fire, forcing the door to its closed position by virtue of the rotationally tensioned spring's kinetic energy.

Figure 7C:
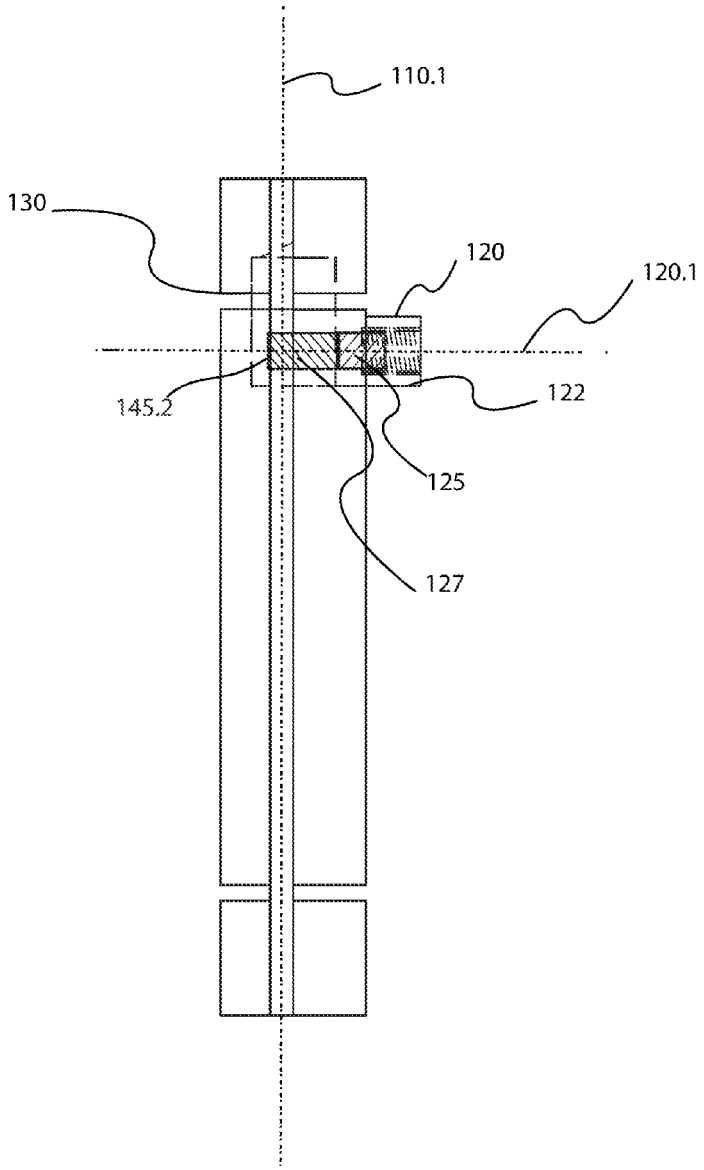
FIG. 7C is a side view of the embodiment shown in FIG. 7A.

FIG. 7A discloses another embodiment of the invention which includes a top view of a new embodiment 100. In this embodiment, there is a jamb leaf 102, having a plurality of screwholes 102.1, 102.2, 102.3, 102.4 (See FIG. 7B). There is a door leaf 104 having a plurality of screwholes 104.1, 104.2, 104.3, 104.4 configured to attach to leaf to a door. Extending in between the plate portions of these leaves is a central cylinder 110. In this embodiment central cylinder comprises cylinders 112 and 116 as well as a cylinder 114. Cylinder 114 is coupled to the jamb leaf 102. The door leaf cylinders 112 and 116 are positioned at opposite ends of the door leaf. Disposed within jamb cylinder 114 is an air channel 114.1 for allowing air to flow into the cylinder. In addition, coupled to this cylinder 114 is a channel 120. As shown in FIG. 7C Channel 120 extends along axis 120.1 which is perpendicular to axis 110.1 of channel 110. Channel 120 has a threaded section 121 and an unthreaded section. Channel 120 is configured to receive the following components: a threaded, vented set screw 122 which has an outside thread 123 and an inner geometry or shape or sides 124 which are configured to receive a tool such as a hex head. Disposed adjacent this set screw and inside of this set screw in channel 120 is a fuse 125. Fuse 125 is configured to melt at high temperatures and then flow out of the vented set screw when it encounters hot gasses associated with a fire. Disposed inside in channel 120 adjacent the fuse is a locking pin 127. Locking pin is held in place by the screwing in of the set screw into the threaded channel 120 with the threads 123 of the set screw meshing with the threads 121 of the channel. As the set screw is screwed in further it drives the fuse 125 and the locking pin to lock a section of a spring 140 in place (See FIG. 8E as well as FIG. 11A.). The locking pin 127 is adjacent to wall 145.1 and is braced against wall 145.2 which is biased against locking pin 127.

As shown in FIG. 7B, disposed at one end is a catchment ring 130. Catchment ring 130 is fixedly coupled to the first cylinder of the door leaf 112 via a set screw 131. When the door leaf rotates with the movement of the door, the catchment ring 130 moves with the door. This catchment ring 130 has a flange or ramp 132 which extends out from the end of the cylinder and along the longitudinal axis 110.1. There is also a torsion spring or coil spring 140 which is coupled along the longitudinal axis 110.1. This spring is shown in greater detail in FIGS. 8G-8I.

Figure 7D:
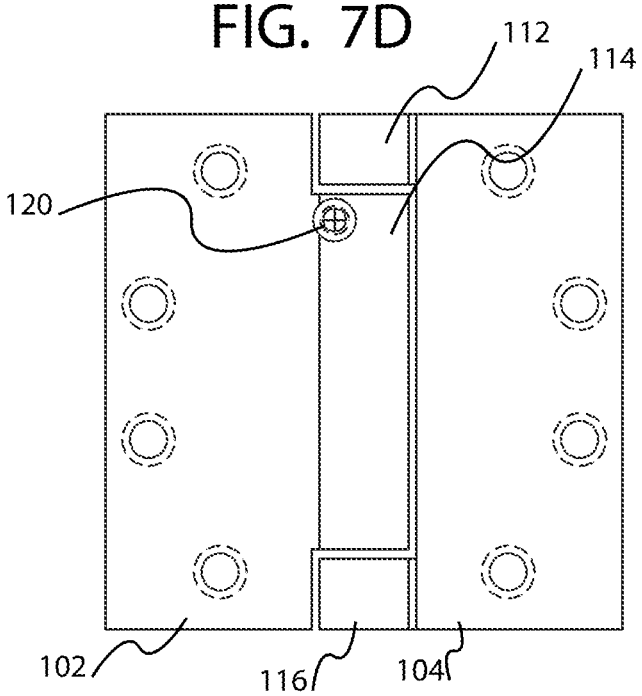
FIG. 7D is an opposite side view from the view shown in FIG. 7B.

Spring 140 includes a first spring end 142 having a set screw 141 for setting the first end in cylinder 114 for the jamb leaf. Thus, the first end 142 is fixed to the jamb leaf while the second end is 146 at least temporarily via the vented set screw, the fuse and the locking pin positioned inside of channel 120. The second end 146 in installation is held in place against the coiled tension of the spring via the locking pin, 127, the fuse 125 and the vented set screw. FIG. 7D shows the connection of channel 120 with cylinder 114.

FIG. 8A is a side view of catchment ring 130 having flange 132 extending out therefrom. FIG. 8B shows another end view of this catchment ring which shows flange 132 as well as the opening 137 for set screw 131. FIGS. 8C and 8D show the side view and end view respectively of another embodiment of a catchment ring having multiple flanges or ramps extending out therefrom. These multiple ramps 132.1, 132.2, 132.3 and 132.4 can be of any number of ramps designed to provide different levels of control or rotation for a door. For example, in the first embodiment shown in FIG. 8A the door has the ability to move up to 220 degrees (See FIG. 11F which allows the door to swing freely open without any hindrance from flange or ramp 148. However, with the embodiment shown in FIG. 8C or 8D these multiple ramps would then hold the door open at a certain pre-set open range based upon where the flange 148 was positioned in relation to the different ramps. For example, if ramp 148 was positioned between ramp 132.1 and 132.2, the door would be positioned open at a first angle. If the ramp 148 was positioned between ramp 132.2 and 132.3, then the door would be positioned open at a second angle. If ramp 148 was positioned between ramp 132.3 and 132.4, then the door would be positioned open at a third angle or at least rotatable within a third range of angles. The different angles or range of angles could be pre-configured based upon the number and/or positions of different ramps on the cylindrical catchment ring.

Figure 8E:
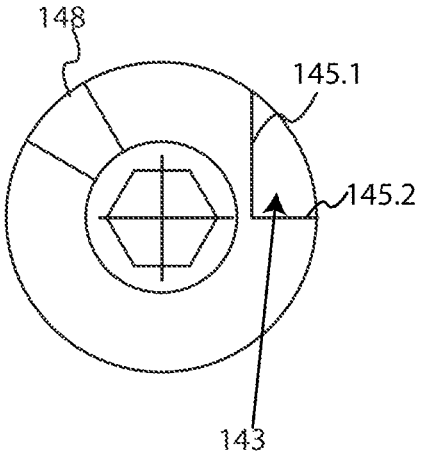
FIG. 8E is an end view of a second end of the spring.

FIG. 8E shows a top view of the end 146 of the spring having a flange 148. Shown in this view of a channel 143 for receiving the locking pin 127 and the fuse 125 as well as the set screw 122. Channel 143 includes walls 145.1 and 145.2 with wall 145.2 being held in place by locking pin 127 preventing end 146 from rotating. Because end 142 is fixed to the door jamb cylinder 114, the coiling of the spring 140 and setting of the spring end 146 which is coupled to door channel 112 causes a bias of this spring to automatically close a door coupled to the hinge when the locking pin moves in channel 120 releasing end 146 to move or rotate in the channel. This view shows set screw 141 coupled to end 142 which sets or fixes the end 142 in the channel. FIG. 8G shows end 146 which also shows this channel 143.

Figure 8F:
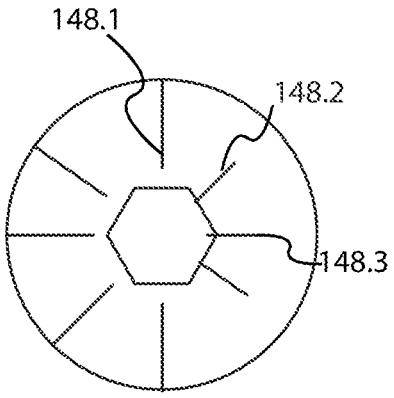
FIG. 8F is an end view of a second embodiment of a second end of the spring.
Figure 8G:
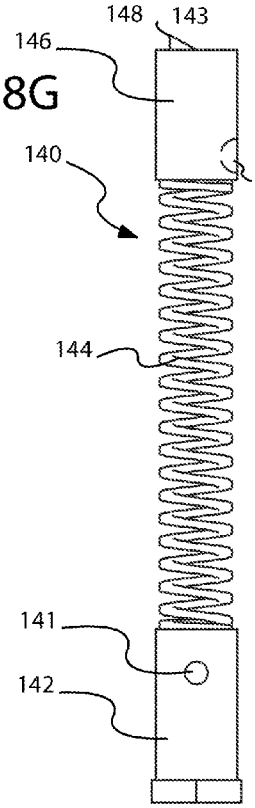
FIG. 8G is a side view of the embodiment of FIG. 8E of the second end of the spring.
Figure 8H:
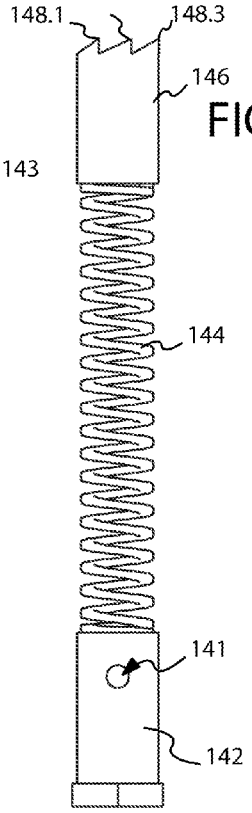
FIG. 8H is a side view of the embodiment of FIG. 8F of the second end of the spring.

FIGS. 8F and 8G show another embodiment which shows an embodiment having flanges, ramps or edges 148.1, 148.2 and 148.3 etc. which extend around the cylinder. This design allows for numerous presets for a door hinge as well so that with this design even in conjunction with the design of FIG. 8A or 8B, the door can be held at multiple different preset angles or ranges.

Figure 8I:
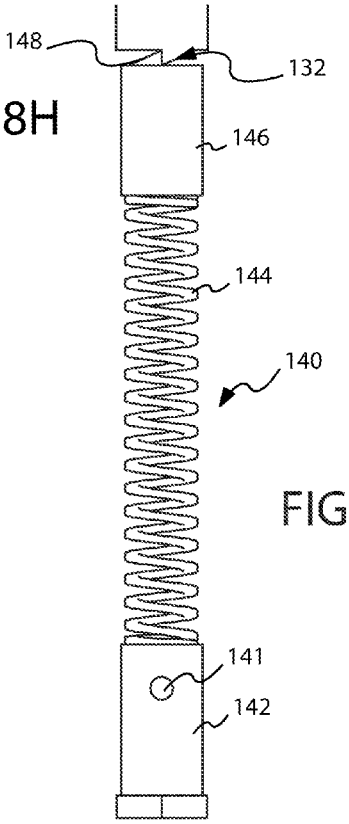
FIG. 8I is a side view of the catchment coupled to the second end of the spring.

FIG. 8I shows a side view of the device which shows catchment ring 130 having flange 132 in coupling combination with flange or ramp 148 of end 146. Thus, with this design, when end 146 is released by the burning or melting of the fuse 125, this causes the movement of the cylinder 146 to rotate within cylinder 112 driving the door jamb 104 to a closed position. The movement of these parts is shown in greater detail in FIGS. 11A-11I.

Figure 9A:
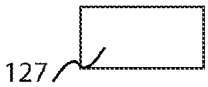
FIG. 9A is a side view of the locking pin.
Figure 9B:
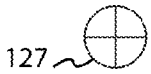
FIG. 9B is an end view of the locking pin.
Figure 9C:
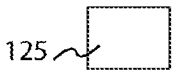
FIG. 9C is a side view of the fuse.
Figure 9D:
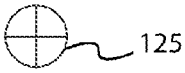
FIG. 9D is an end view of the fuse.
Figure 9E:
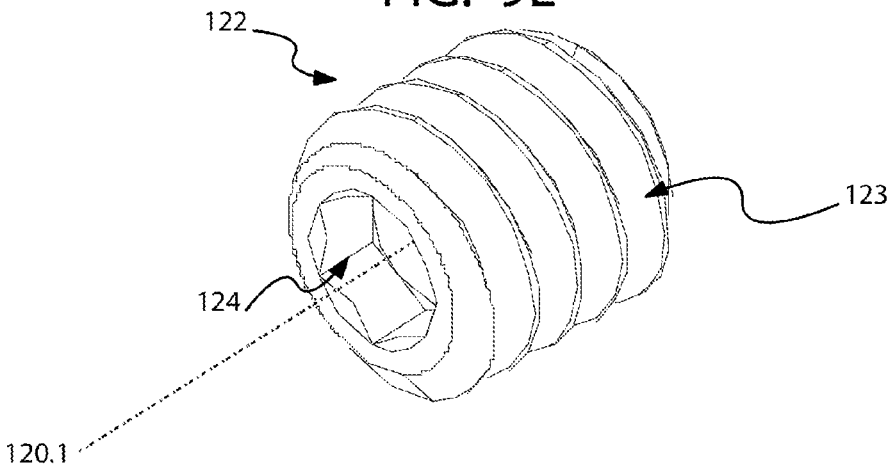
FIG. 9E is a perspective view of the vented set screw.
Figure 9G:
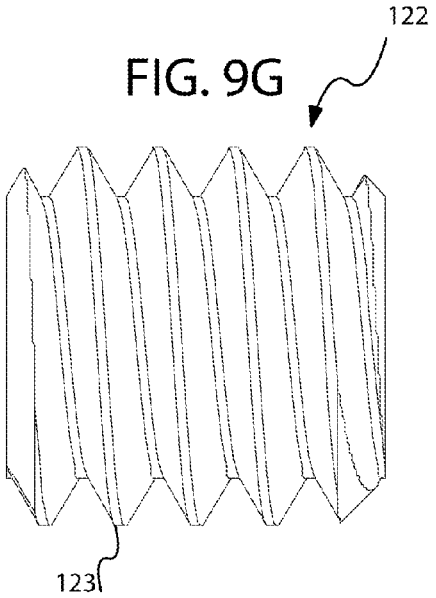
FIG. 9G is a side view of the vented set screw.
Figure 9F:
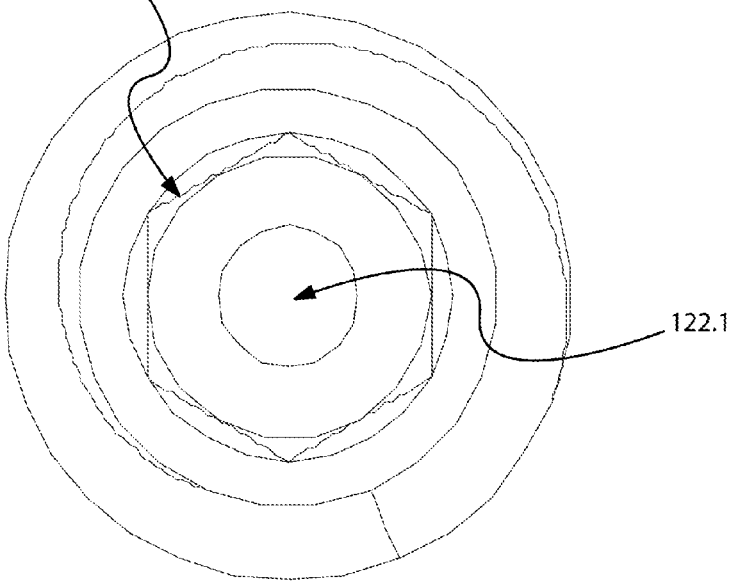
FIG. 9F is an end view of the vented set screw.

FIGS. 9A and 9B show the cylindrical locking pin 127. FIGS. 9C and 9D show the fuse 125. FIGS. 9E, 9F and 9G show the cylindrical vented set screw 122. This vented set screw has an opening vent 122.1 which extends along the longitudinal axis or extension axis of this set screw which is along axis 120.1 which is parallel to or coaxial to the longitudinal extension of the locking pin 127 as well as the fuse 125. Fuse 125 is designed to melt at an approximate predetermined temperature so that material from the fuse flows out from channel or opening 122.1 and out of the vented set screw 122. The geometry 124 is set so that it is large enough to receive a turning tool such as a screwdriver or a hex head but small enough to not allow the fuse to flow there-through unless it is in a melting or melted condition. The geometry is such that it can have multiple sides and edges so that it catches or meshes with a tool such as a turning tool which then allows the vented set screw to turn. The turning in of this vented set screw results in a selected positional setting for this set screw and consequently the fuse and the locking pin. This allows the screw to take advantage of the mechanical advantage gained by the screw as it drives and even can crank the spring further in its coiled position.

Figure 10D:
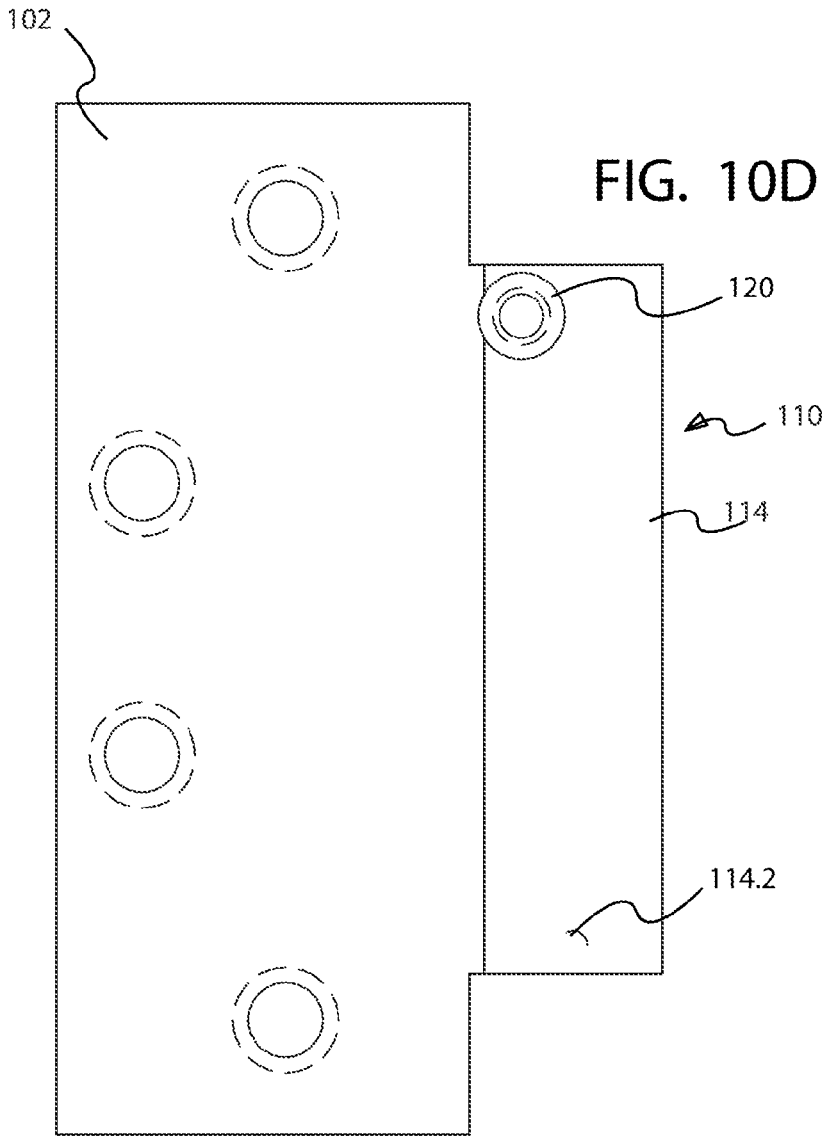
FIG. 10D is a side view of the jamb leaf.
Figure 10E:
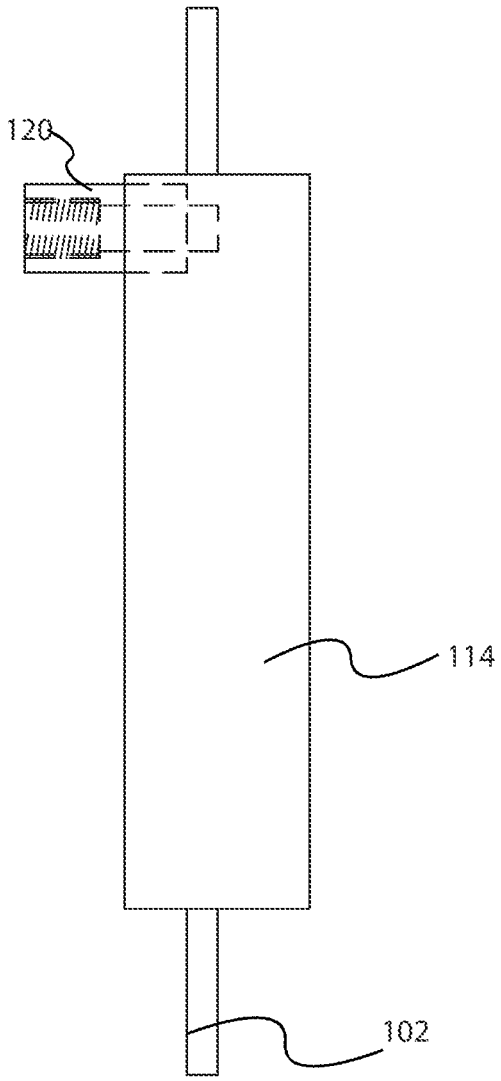
FIG. 10E is another side view of the jamb leaf shown in FIG. 10D rotated 90 degrees.
Figure 10F:
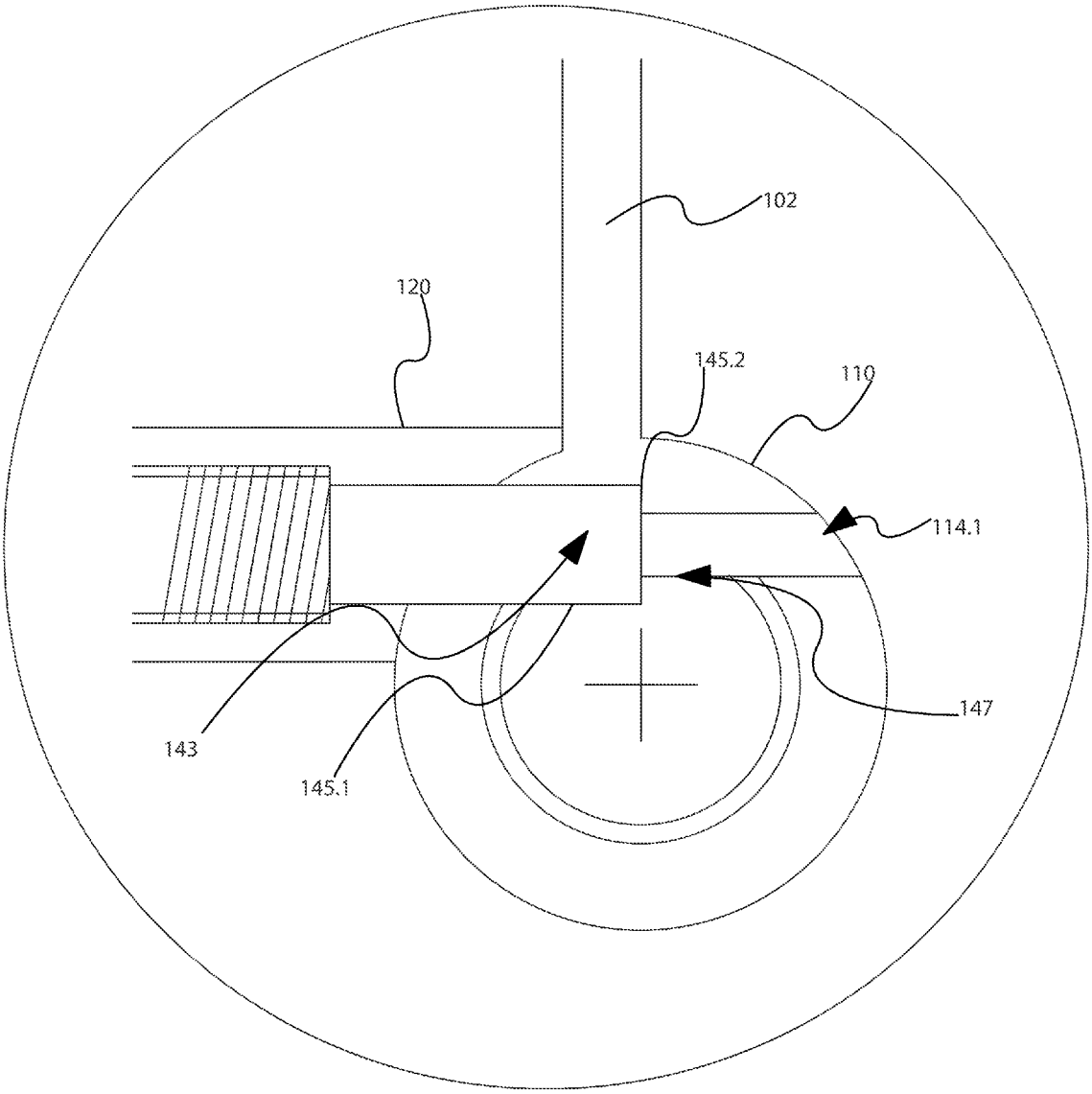
FIG. 10F is a top close up view of the jamb leaf and cylinder portion of the jam b leaf.

FIGS. 10A, 10B, and 10C show the different angled views for the channel 120. Jamb leaf 102 is shown in FIGS. 10C and 10D with channel 120 extending transverse to the extension of cylinder 114 or cylinder 110. As shown in FIG. 10C, channel 120 extends transverse to cylinder 110. Inside of these cylinders as wells as inside of end 146 are channels 147 as well as channel 114.1 inside of channel 114. Channel 114.1 allows air to vent into the channel allowing the fuse and the locking pin to be greater exposed to the outside environment. In addition channel 147 also forms an open channel in end 146 to allow air or the environment react to the contents inside channel 120. Channel 147 is smaller in diameter or at least opening than locking pin 127 so that locking pin 127 can still brace end 146 in a locked position against surface or wall 145.2. These features are also shown in greater detail in FIGS. 10E and 10F as well.

Figure 11A:
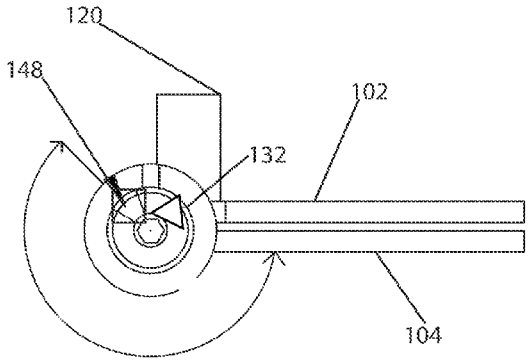
Figure 11B:
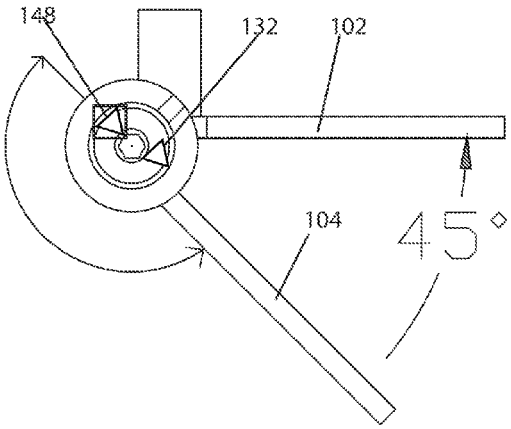
Figure 11C:
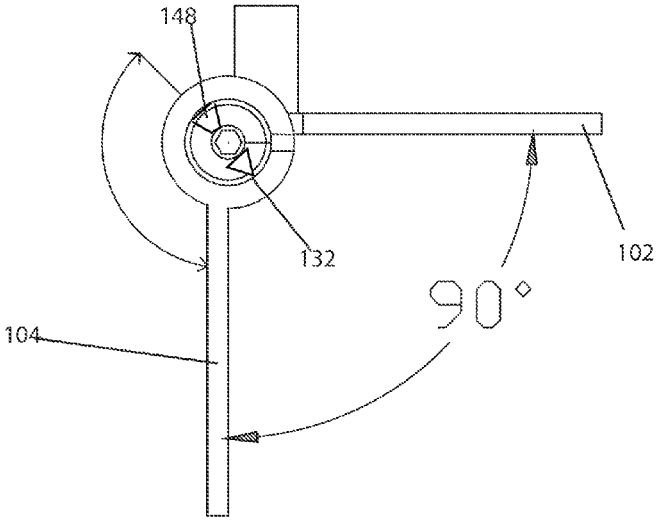
Figure 11G:
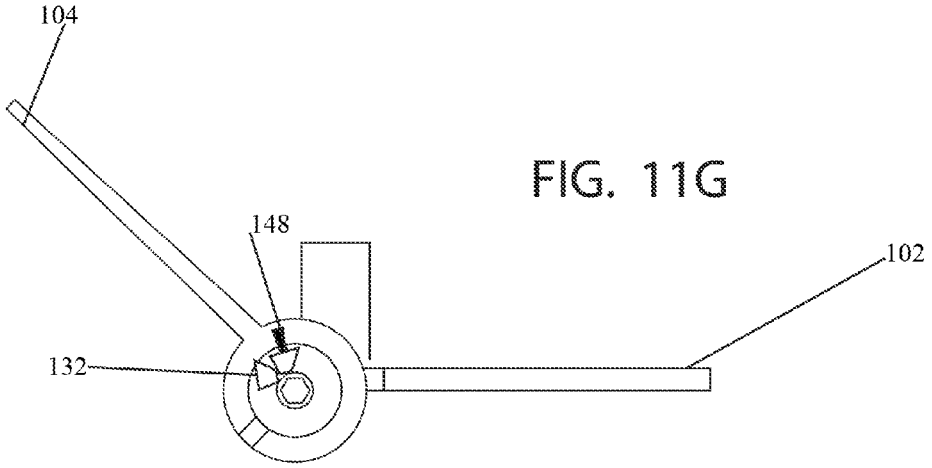
FIGS. 11G-11L show the progression for closing a door leaf or door.
Figure 11H:
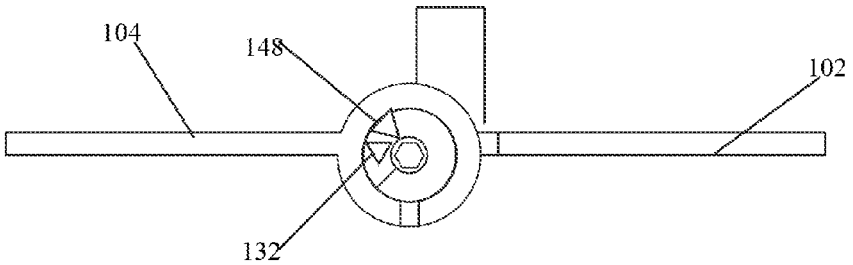
Figure 11I:
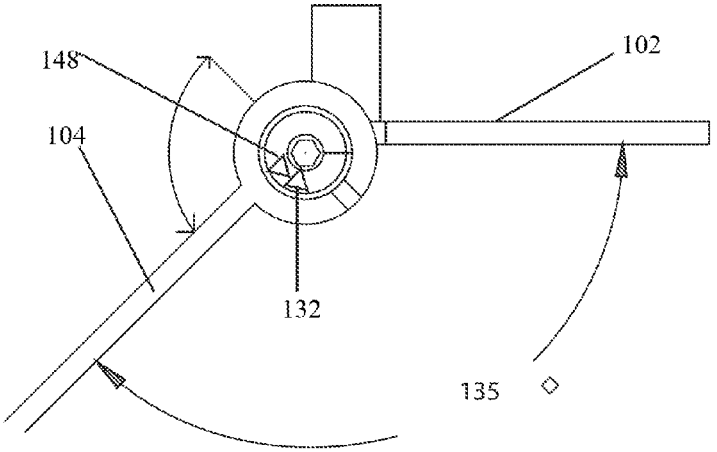
Figure 11J:
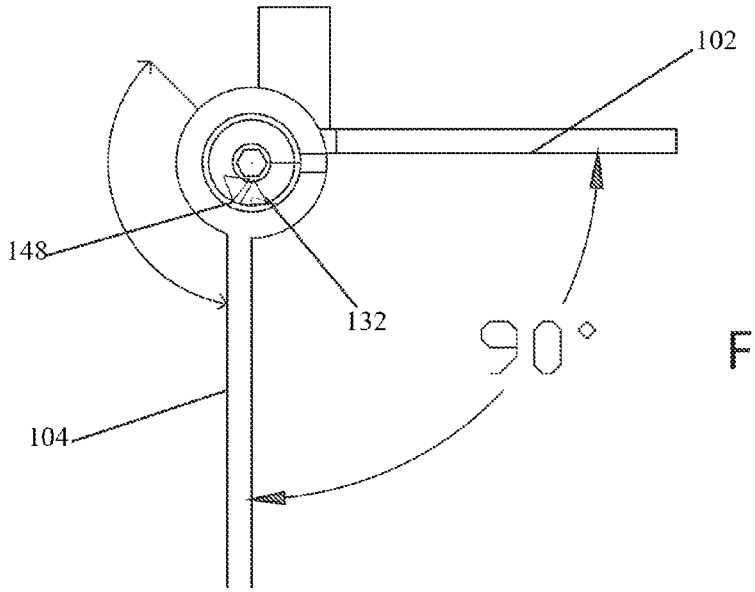
Figure 11K:
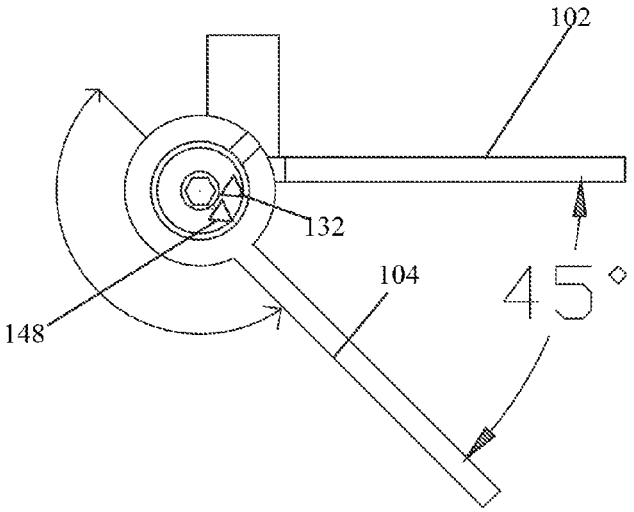
Figure 11L:
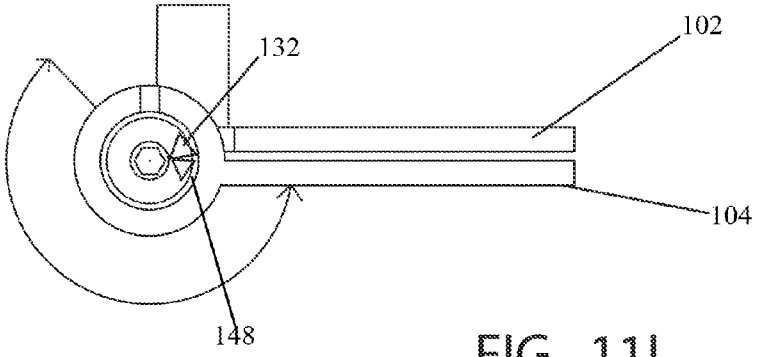

FIGS. 11A-11F show the different angles of rotation of the hinge from a closed position in FIG. 11A to a fully open position in FIG. 11F. As shown in this progression, flange 132 rotates with the rotation of the door, while flange 132 stays fixed in position. FIGS. 11G 11L show the progression back to closing the door.

In at least one embodiment, the system can be designed to be preset open at these different angles depending on the position of the flanges. Using the design shown in either FIG. 8D or 8F the door can be preset at multiple different angles of opening with multiple flanges positioned or arrayed around the top of the cylinder.

When a fire or high heating occurs, the door may be in an open position, even in an open position of up to 220 degrees. In this position, when hot gasses enter into the vents or channels 120.1, 114.1, 147 these hot gasses can melt the fuse 125 causing it to flow out from this channel 122.1 and then allow the locking pin 127 to slide towards the vented set screw 122 along channel 143 to cause the locking pin to slide within channel 122.1 and to remove itself from impinging on the movement of end 146. With end 146 being biased by the spring but originally fixed by the pin, the spring 144 now starts to uncoil driving flange 148 around and into flange 132. Once flange 148 contacts flange 132, it causes a door leaf 104 to rotate towards a closed position and towards jamb leaf 102. This rotation thereby causes a door to rotate closed as well. Thus FIGS. 11G-11L show the rotation of these leaves and thereby doors as they rotate towards a closed position.

It will be understood that each of the elements described above, or two or more together, may also find a useful application in other types of methods differing from the type described above. While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Thus in summary, with this other embodiment 100 the door closure device a device configured to close a door during elevated temperatures This device comprises a hinge comprising a jamb leaf 102 configured to couple to a door jamb (see FIG. 2). A door leaf 104 configured to couple to a door such as door 12. At least one knuckle which in one embodiment comprises a cylinder 114 coupled to the jamb leaf 102. There is at least one knuckle comprising cylinders 112, and 116 coupled to the door leaf 104. There is least one actuator disposed in the hinge which can be disposed inside of the cylinders 112, 114, and 116 of the hinge. There is also at least one lock 119 for locking the actuator 111 from acting on jamb leaf 102 and door leaf 104. The lock in at least one embodiment comprising a fusible block 125 and at least one locking pin. The lock can also optionally comprise at least one lock housing comprising a cylinder 120 coupled to the hinge and configured to house fusible block 125 and locking pin 127. To set the lock there is a set screw 122 coupled to a housing comprising channel 120 and configured to set fusible block 125 and locking pin 127 in place. The door knuckle comprising cylinders 112, and 116 and jamb knuckle comprising cylinder 114 are configured to at least partially house actuator 111, and lock housing comprising channel 120 is coupled to the jamb knuckle comprising cylinder 114.

The lock housing comprising channel 120 has a plurality of threads 121 disposed in an interior region and is configured as substantially cylindrical. Set screw 122 has a plurality of threads 123 on an outside surface for interacting with threads 121 on channel 120 to screw in and set said fusible block 125 and said locking pin 127 in place to lock actuator 111 from closing the door.

In at least one embodiment, the set screw 122 has a screw head 124 configured to receive a tool for allowing the set screw 122 to be screwed in. Thus, the door closure device 100 is configured such that during normal operation actuator 111 is coiled but fixed against rotation via lock 119.

Set screw 122 further comprises an open channel 122.1, wherein when the lock experiences an elevated temperature, such as during a fire, which can drive temperatures above 150 degrees, above 170 degrees or even above 180 or 190 degrees Fahrenheit, fusible block 125 melts, flowing into open channel 122.1 of set screw 122, causing locking pin 127 to move into channel 122.1 of set screw 122, releasing locking pin 127 and causing said actuator to act upon door leaf 104 to cause the door leaf 104 to close against jamb leaf 102.

This actuator 111 can comprise a spring such as a torsion spring which can be wound in tension and then locked in place via the lock 119 to prevent the spring from rotating during normal state.

As described above, the actuator comprises a catchment ring 130 coupled to door leaf knuckle 112. This catchment ring has a flange 132. The first end section 146 is coupled to spring 144 and has a complementary flange 148. There is the second end section 140 coupled to spring 144, opposite first end section 146, the second end section 140 being disposed adjacent to catchment ring 130. Thus, when fusible block 125 melts, locking pin 127 moves into set screw channel 122.1 releasing second end 146, wherein spring 144 drives second end flange 148 into flange 132 of catchment ring 130 thereby driving the door closed.

As described above, the door closure operates such that during normal operation, the lock 119 fixes the actuator 111 such that the door leaf 104 is configured to freely rotate past 180 degrees with respect to jamb leaf 102.

Figure 12A:
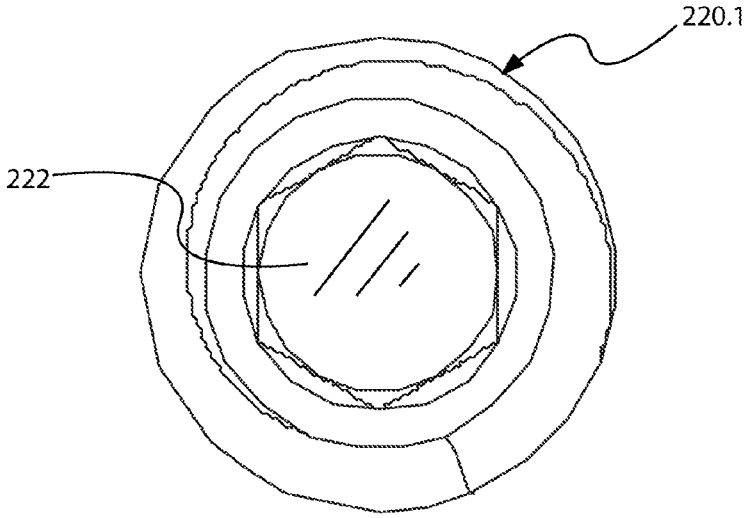
FIG. 12A is a first view of a set screw.
Figure 12B:
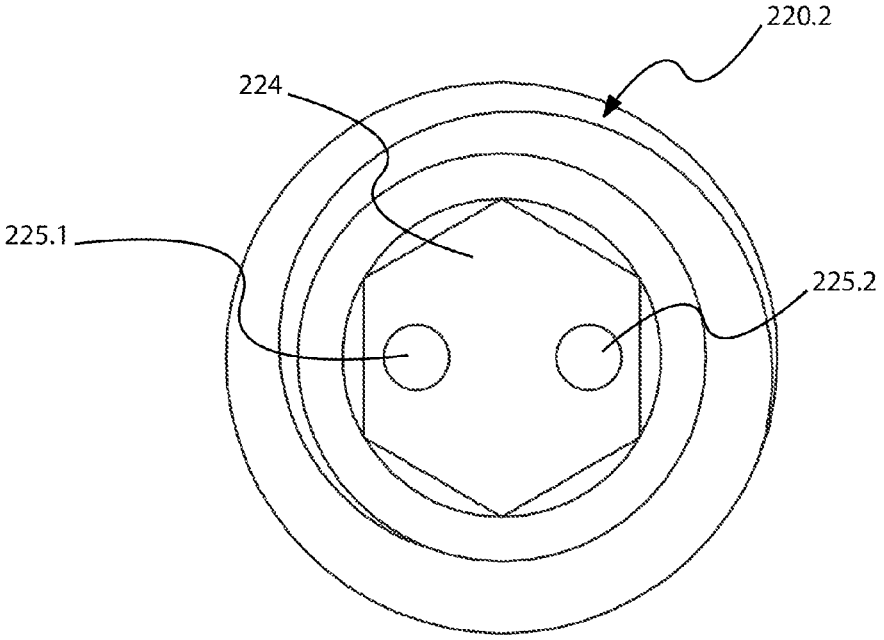
FIG. 12B is a second view of a set screw.

As shown in FIGS. 12A and 12B there can be other types of set screws as well. The first embodiment of set screws 220.1 includes a flat flush face which blocks the flow of the fusible block 25 into a channel or vent such as vent 122.1. Alternatively FIG. 12B discloses another embodiment 220.2 which shows a face 224 and two holes 225.1 and 225.2 which form a channel to allow for the flow of the fusible block therein. The flush surface 222 or the surface formed by block 224 as well as holes 225.1 and 225.2 are configured to provide more surface area so that the flow of the fusible block 125 is relatively slower than with the other embodiments disclosed above. This allows for a more resilient lock in the face of an elevated temperature.

DESCRIPTION OF THE REFERENCED NUMERALS

Turning now descriptively to the drawings, in which similar reference characters denote similar elements throughout the several views, the figures illustrate the Fusible Block Door Closure of the present invention. With regard to the reference numerals used, the following numbering is used throughout the various drawing figures.

10 Fusible Block Door Hinge
12 door
14 hinge
16 jamb plate
18 door plate
20 knuckle of 16
22 knuckle Of 18
24 locking pin
26 fusible block channel of 18
28 tension hinge pin
30 composite hinge pin
32 fastener aperture of 28
34 spring fastener of 28
36 tensioning aperture of 28
38 knuckle-staked member of 30
40 fastener aperture of 38
42 nub of 38
44 knuckle-anchored member of 30
46 spring fastener of 44
48 nub of 44
50 fusible block cavity of 44
52 torsion spring
54 fusible block
56 roll pin
58 aperture of 22
60 aperture of 20
100 Second Embodiment
102 Jamb leaf
102.1 jamb hinge screw hole
102.2 jamb hinge screw hole
102.3 jamb hinge screw hole
102.4 jamb hinge screw hole
104 door leaf
104.1 door hinge screw hole
104.2 door hinge screw hole
104.3 door hinge screw hole
104.4 door hinge screw hole
110 central extension of cylinders
110.1 longitudinal axis
111 Actuator
112 first cylinder/knuckle for door leaf
114 cylinder/knuckle for jamb leaf/central cylinder
114.1 air channel for air flow in cylindrical body
116 second cylinder/knuckle for door leaf
119 Lock
120 channel
120.1 longitudinal axis for channel
121 channel thread
122 vented set screw
122.1 vent for vented set screw
123 vented set screw thread
124 geometry or surface for hex head or screw (angled surface)

125 fuse
127 locking pin
130 catchment ring
131 set screw
132 flange or ramp
132.1 first ramp
132.2 second ramp
132.3 third ramp
132.4 fourth ramp
137 opening for the set screw 131
140 torsion spring or coil spring
141 set screw for torsion spring into the jamb channel
142 first end section for spring
143 channel
144 spring body
145.1 channel wall
145.2 channel wall
146 second end section for spring
147 vent for end 146
148 edge or flange for second end section
148.1 first edge or flange for second end section
148.2 second edge or flange for second end section
148.3 third edge or flange for second end section
222 flush face;
220.1 another embodiment having a flush face;
220.2 Another embodiment having two holes for venting the fusible block;
224 face;
225.1 first hole;
225.2 second hole.

Accordingly, while at least one embodiment of the present invention has/have been shown and described, it is to be understood that many changes and modifications may be made thereunto without departing from the spirit and scope of the invention as defined in the appended claims.

What is claimed is:

1. A door closer configured to close a door during elevated temperatures comprising:

a) a hinge comprising:
- i) a jamb leaf configured to couple to a door jamb;
- ii) a door leaf configured to couple to a door;
- iii) at least one knuckle coupled to the jamb leaf;
- iv) at least one knuckle coupled to the door leaf;

b) an actuator disposed in said hinge, said actuator comprising:
- i) a spring
- ii) a catch coupled to said door leaf knuckle and having a flange;
- iii) a first end section fixed to said jam leaf knuckle, and coupled to said spring;
- iv) a second end section having a flange, coupled to said spring, opposite said first end section, said second end section being disposed adjacent to said catch, and
- v) an actuator channel;

c) a lock for locking said actuator from acting on said jamb leaf and said door leaf, comprising:
- i) a fusible block;
- ii) a locking pin;
- iii) a lock housing coupled to said hinge configured to house said fusible block and said locking pin; and
- iv) a set screw coupled to said housing and configured to set said fusible block and said locking pin in place;

wherein said locking in extends in said actuator channel and said lock housing; wherein when said fusible block melts, said locking pin is driven by said actuator from a first position in said actuator channel and said lock housing to a second position outside said actuator channel releasing said second end of the actuator, wherein said spring drives said second end flange into said flange of said catch thereby driving the door closed.

2. The door closer as in claim 1, wherein said door knuckle and said jamb knuckle are configured to at least partially house said actuator, and said lock housing is coupled to said jamb knuckle and has a plurality of threads disposed in an interior region and is configured as substantially cylindrical and said set screw has a plurality of threads on an outside surface for interacting with said threads on said lock housing to screw in and set said fusible block and said locking pin in place to lock said actuator from closing the door.

3. The door closer as in claim 1 wherein said set screw has a screw head configured to receive a tool for allowing the set screw to be screwed in.

4. The door closer as in claim 1, wherein said set screw further comprises an open channel for the fusible block to flow in to when it melts.

5. The door closer as in claim 1, wherein during normal operation, the lock fixes the actuator such that the door leaf is configured to freely rotate past 180 degrees with respect to said jamb leaf.

6. The door closer as in claim 1, wherein said second end is biased by said spring, and said second end is held in place by said lock.

7. The door closer as in claim 1, wherein said lock housing comprises a channel which extends transverse to a direction of a longitudinal axis of said jamb knuckle.

8. The door closer as in claim 1, wherein said lock housing comprises a channel which extends transverse to a direction of a longitudinal axis of said leaf knuckle.

9. The door closer as in claim 1, wherein said spring is a torsion spring.

10. The door closer as in claim 1, wherein said catch is a catchment ring.

* * * * *